United States Patent [19]

Kincaid et al.

[11] 4,350,542

[45] Sep. 21, 1982

[54] BONDING AGENT FOR HMX (CYCLOTETRAMETHYLENETETRANITRAMINE)

[75] Inventors: John F. Kincaid, Arlington, Va.; Russell Reed, Jr., Ridgecrest, Calif.

[73] Assignee: The United States of America as represented by the Secretary of the Navy, Washington, D.C.

[21] Appl. No.: 135,563

[22] Filed: Mar. 31, 1980

[51] Int. Cl.[3] ..... C06B 45/22; C06B 25/34; C07D 251/14

[52] U.S. Cl. ..... 149/11; 149/92; 149/109.2; 260/239 HM; 544/215

[58] Field of Search ..... 149/11, 92, 109.2; 260/239 HM; 544/215 RD

[56] References Cited

U.S. PATENT DOCUMENTS

| | | | |
|---|---|---|---|
| 3,190,770 | 6/1965 | Ender | 149/11 |
| 3,190,775 | 6/1965 | Ender | 149/11 |
| 3,373,062 | 3/1968 | Morris | 149/11 |
| 3,767,488 | 10/1973 | Seals | 149/11 |
| 3,984,264 | 10/1976 | Lampert | 149/11 |
| 4,038,115 | 7/1977 | Dehm | 149/11 |

*Primary Examiner*—John M. Ford
*Assistant Examiner*—Robert C. Whittenbaugh
*Attorney, Agent, or Firm*—R. F. Beers; W. T. Skeer; B. H. Cottrell

[57] ABSTRACT

The present invention relates to an improved propellant or explosive and method for making it having increased energy yet having increased toughness and hazard properties. More specifically, an HMX or RDX material is coated with a nitrocellulose, poly-hydroxyethyl acrylate or poly-hydroxymethyl acrylate for bonding hydroxyl groups that subsequently allows reaction with amine silane/s or a polymer of the type $$-N(CH_2)_nN-$$
$$(CH_2)_m$$
$$Si(OR)_3$$

wherein n is an integer of 3 or 4, m is an integer of 2 or 3, and R is methyl or ethyl. Further coating of the product is then carried out with a primary hydroxyl forming material and then curing the product in the presence of an isocyanate.

27 Claims, No Drawings

BONDING AGENT FOR HMX (CYCLOTETRAMETHYLENETETRANITRAMINE)

BACKGROUND OF THE INVENTION

1. Field of the Invention

The present invention relates to propellants and explosives. More particularly, it pertains to increasing energy in propellants and explosives in order to obtain longer range and greater payload.

2. Description of the Prior Art

Various ingredients are used to coat cyclotetramethylenetetranitramine (HMX) or cyclotrimethylenetrinitramine (RDX) which contain reactive functional groups capable of reacting to produce a chemical linkage of the binder to the coating, a process which occurs during the curing of a propellant. HMX and RDX are routinely used in propellants and explosives that contain desensitizing organic binders, such as, polyurethanes. However, neither HMX nor RDX crystals bond well to binders thus causing poor mechanical properties in the final compositions. Moreover, recent studies show that such compositions having poor mechanical properties result in propellants or explosives with less resistance to inadvertent ignition and detonation, thus creating a true safety hazard and possibly not fulfilling the intended purpose.

SUMMARY OF THE INVENTION

The present invention solves the above problems by providing a unique propellant composition and process for its preparation having enhanced toughness and improved hazard properties of a HMX or RDX structure coated with a material selected from the group consisting of nitrocellulose, polyglycidylacrylate and polyglycidylmethylacrylate; an amino silane selected from the group consisting of $H_2N(CH_2)_nSi(OR)_3$ wherein n=3 and R=methyl or ethyl; $H_2N(CH_2)_mN(CH_2)_nSi(OR)_2$ wherein n=3 or 4 and m=2 or 3; $H_2N(CH_2)_pN(CH_2)_m N(CH_2)_nSi(OR)_3$ wherein n=3 or 4, m=2 or 3, and p=2 or 3; and $H_2N(CH_2)_qN(CH_2)_pN(CH_2)_mN(CH_2)_nSi(OR)_3$ wherein n=3 or 4, m=2 or 3, p=2 or 3, and q=2 or 3; or a polymer of the type

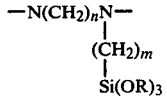

wherein n is an integer of 3 or 4, m is an integer of 2 or 3, and R is methyl or ethyl; a primary hydroxyl forming material selected from the group consisting of epsilon caprolactone, polycaprolactone and ethylene oxide; and an isocyanate.

OBJECTS OF THE INVENTION

It is an object of the present invention to provide a propellant or explosive with increased energy yet having increased toughness and hazard properties.

Another object of the present invention is to provide a novel method for the preparation of a propellant or explosive having increased energy yet having improved toughness and hazard properties.

These and other objects, features and advantages will become apparent from the following detailed description of the invention.

DESCRIPTION OF THE PREFERRED EMBODIMENTS

This invention provides a unique propellant composition and method for its preparation heretofore unavailable.

The use of coating material nitrocellulose or other hydroxyl containing materials, for example, polyhydroxyethyl acrylate or poly-hydroxymethyl acrylate to effect the hydroxyl interaction to the surface of HMX or RDX serves to bond the hydroxyl containing material to the HMX or RDX and to subsequently allow bonding of the then attached hydroxyl groups to the amine salines as described above or the polymer of the type

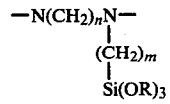

wherein n is an integer of 3 or 4, m is an integer of 2 or 3, and R is methyl or ethyl. This coated HMX or RDX product at this stage of the process is then made permanently bondable by further coating the HMX or RDX product with a primary hydroxyl forming material and then curing with an isocyanate.

The following examples are presented only to illustrate the invention:

EXAMPLE 1

A 2 gm. nitrocellulose (NC) in 50% of an ethyl acetate solvent is added to 100 gms. cyclotetramethylenetetranitramine (HMX). The mixture is tumbled in a ribbed flask for 3 hours, followed by heating to 70° C. for 24 hours at 1-3 mmHgvac. The solvent ethyl acetate is then evaporated. A HMX coated with NC is obtained as a free flowing powder of seemingly the same particle size.

The HMX coated with NC is suspended in Freon followed by adding a methylene chloride solution of 1% of an amine silane. The following amine silane solutions were investigated: $H_2NCH_2CH_2NHCH_2CH_2CH_2Si(OCH_3)_3$, $H_2NCH_2CH_2CH_2Si(OCH_3)_3$, and $H_2NCH_2CH_2NHCH_2 CH_2CH_2Si(OCH_3)_3$. Also, polymers of the type

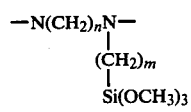

were investigated wherein n is an integer of 3 or 4 and m is an integer of 2 or 3.

The solution is stirred gently for 20 minutes, filtered and the solid obtained is washed with methylene chloride. To the damp solid obtained, an amount of epsilon-caprolactone dissolved in benzene sufficient to react with the available primary and secondary amine groups is added. The HMX product is removed by filtration and dried in a vacuum. The HMX product is screened, as necessary, for sizing and yields free flowing propellant particles. Each amine silane utilized yields free flowing propellant particles. Microscopic examination of the free flowing propellant particles upon being pulled apart revealed excellent bonding in all instances.

EXAMPLE 2

An NC in an ethyl acetate solvent is added to cyclotrimethylenetrinitramine (RDX) in the same proportions as in Example 1. The mixture is then tumbled in a blender. A NC coated RDX is obtained upon evaporation of the ethyl acetate. A methylene chloride solution in Freon containing an amine silane is added. The solution is stirred gently for about 25 minutes, filtered and the filtered solid is washed with methylene chloride. An amount sufficient to react with the available primary and secondary amine groups of epsilon-caprolactone dissolved in benzene is added. The RDX product is filtered out of the solution and vacuum dried. The RDX product is screened for sizing and yields free flowing particles. Excellent bonding was obtained.

EXAMPLE 3

This example utilizes the same ingredients and conditions as in Examples 1 and 2 except a polymer of the type

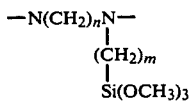

is used wherein n is an integer of 3 or 4 and m is an integer of 2 or 3 in a solvent of tetrahydrofuran. The resultant product yields free flowing propellant particles upon screening, for sizing. Excellent bonding was obtained upon being pulled apart and examined by microscope.

EXAMPLE 4

This example utilizes the same ingredients and conditions as in Examples 1, 2, and 3 except a mixture of NC and nitroglycerine (NG) is used instead of NC. The resultant product yields, upon sizing by screening, free flowing propellant particles. Excellent bonding was obtained.

EXAMPLE 5

This example utilizes the same ingredients and conditions as in Examples 1, 2, and 3 except polyhydroxyethyl acrylate and poly-hydroxymethyl acrylate are used separately instead of NC. In each instance the resultant product yields, upon sizing by screening, free flowing propellant particles.

EXAMPLE 6

This example utilizes the same ingredients and conditions as in Examples 1, 2, and 3 except polycaprolactone and ethylene oxide are used instead of epsilon caprolactone. In each instance the resultant product yields, upon screening, free flowing propellant particles.

The product is repeatedly tested for toughness of product. Each test utilizing the resultant propellant product made in accordance with the teaching examples indicated excellent toughness properties which substantially eliminated detonation upon ignition of the weapon. The safety obtained from the unique propellant of this invention is extremely important in substantially eliminating inadvertent ignition and detonation.

What is claimed is:

1. A process for the preparation of a propellant composition having enhanced toughness and improved hazard properties which comprises:

coating an HMX or RDX structure with a material to effect the hydroxyl interaction to the surface of HMX or RDX selected from the group consisting of nitrocellulose, poly-hydroxyethyl acrylate and poly-hydroxymethyl acrylate, or mixture thereof;

treating said coated HMX or RDX structure with an amino silane selected from the group consisting of $H_2N(CH_2)_nSi(OR)_3$ wherein n=3 and R=methyl or ethyl; $H_2N(CH_2)_mN(CH_2)_nSi(OR)_3$ wherein n=3 or 4 and m=2 or 3, and R=methyl or ethyl; $H_2N(CH_2)_pN(CH_2)_mN(CH_2)_nSi(OR)_3$ wherein n=3 or 4, m=2 or 3, p=2 or 3, and R=methyl or ethyl; and $H_2N(CH_2)_qN(CH_2)_pN(CH_2)_mN(CH_2)_nSi(OR)_3$ wherein n=3 or 4, m=2 or 3, p=2 or 3, q=2 or 3, and R=methyl or ethyl or mixtures thereof;

reacting said amino silane treated and coated HMX or RDX structure with a primary hydroxyl forming material selected from the group consisting of epsilon caprolactone, glycidol, and ethylene oxide, and curing said HMX or RDX structure in the presence of a binder and forming a permanent bond between said HMX structure and said binder.

2. A process as in claim 1 wherein said coating material is nitrocellulose.

3. A process as in claim 1 wherein said coating material is poly-hydroxyethyl acrylate.

4. A process as in claim 1 wherein said coating material is poly-hydroxymethyl acrylate.

5. A process as in claim 1 wherein said primary hydroxyl forming material is epsilon caprolactone.

6. A process as in claim 1 wherein said primary hydroxyl forming material is glycidol.

7. A process as in claim 1 wherein said primary hydroxyl forming material is ethylene oxide.

8. A process as in claim 1 wherein said binder is selected from the group consisting of hydroxyl terminated pre-polymers of polyethers and polyesters.

9. A process as in claim 8 wherein said polyethers and polyesters are selected from the group consisting of isocyanates, polycaprolactone, polyethylene glycol and mixed polyethylene and polypropylene glycols.

10. A process as in claim 9 wherein said isocyanates are selected from the group consisting of dimer acid diisocyanate, biuret trimer of hexamethylene diisocyanate, lysine methyl ester diisocyanate and hexamethylene diisocyanate.

11. A process for the preparation of a propellant composition having enhanced toughness and improved hazard properties which comprises:

coating an HMX or RDX structure with a material selected from the group consisting of nitrocellulose, poly-hydroxyethyl acrylate and poly-hydroxymethyl acrylate;

treating said coated HMX or RDX structure with a polymer of the type

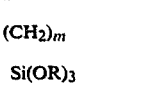

wherein n is an integer of 4 or less, m is an integer of 3 or 4, and R is methyl or ethyl;

reacting said polymer treated coated HMX or RDX structure with a primary hydroxyl forming material selected from the group consisting of epsilon caprolactone, glycidol, and ethylene oxide, and curing said HMX structure in the presence of a binder and forming a permanent bond between said HMX or RDX structure and said binder.

12. A process as in claim 9 wherein said coating material is nitrocellulose.

13. A process as in claim 9 wherein said coating material is poly-hydroxyethyl acrylate.

14. A process as in claim 9 wherein said coating material is poly-hydroxymethyl acrylate.

15. A process as in claim 9 wherein said primary hydroxyl forming material is epsilon caprolactone.

16. A process as in claim 9 wherein said primary hydroxyl forming material is glycidol.

17. A process as in claim 9 wherein said primary hydroxyl forming material is ethylene oxide.

18. A process as in claim 11 wherein said binder is selected from the group consisting of hydroxyl terminated pre-polymers of polyethers and polyesters.

19. A process as in claim 18 wherein said polyethers and polyesters are selected from the group consisting of isocyanates, polycaprolactone, polyethylene glycol and mixed polyethylene and polypropylene glycols.

20. A process as in claim 19 wherein said isocyanates are selected from the group consisting of dimer acid diisocyanate, biuret trimer of hexamethylene diisocyanate, lysine methyl ester diisocyanate and hexamethylene diisocyanate.

21. A propellant composition having enhanced toughness and improved hazard properties comprising an HMX or RDX structure coated with (a) material selected from the group consisting of nitrocellulose, nitroglycerine, polyglycidylacrylate and polyglycidylmethylacrylate or mixture thereof, (b) an amino silane selected from the group consisting of $H_2N(CH_2)_nSi(OR)_3$ wherein n=3 and R=methyl or ethyl; $H_2N(CH_2)_mN(CH_2)_nSi(OR)_3$ wherein n=3 or 4, m=2 or 3, and R=methyl or ethyl; $H_2N(CH_2)_pN(CH_2)_mN(CH_2)_nSi(OR)_3$ wherein n=3 or 4, m=2 or 3, p=2 or 3, and R=methyl or ethyl; and $H_2N(CH_2)_qN(CH_2)_p$ $N(CH_2)_mN(CH_2)_nSi(OR)_3$ wherein n=3 or 4, m=2 or 3, p=2 or 3, q=2 or 3, and R=methyl or ethyl or a polymer of the type

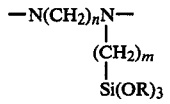

wherein n is an integer of 4 or less, m is an integer of 3 or less, and R is methyl or ethyl; (c) a primary hydroxyl forming material selected from the group consisting of epsilon caprolactone, polycaprolactone and ethylene oxide; and (d) an isocyanate.

22. A propellant composition as in claim 21 wherein said coating material is nitrocellulose.

23. A propellant composition as in claim 21 wherein said coating material is poly-hydroxyethyl acrylate.

24. A propellant composition as in claim 21 wherein said coating material is poly-hydroxymethyl acrylate.

25. A propellant composition as in claim 21 wherein said primary hydroxyl forming material is epsilon caprolactone.

26. A propellant composition as in claim 21 wherein said primary hydroxyl forming material is polycaprolactone.

27. A propellant composition as in claim 21 wherein said primary hydroxyl forming material is ethylene oxide.

* * * * *